US011639729B2

(12) United States Patent
Allard

(10) Patent No.: US 11,639,729 B2
(45) Date of Patent: May 2, 2023

(54) EXPLOSIVELY PROPELLED PISTON ASSEMBLY

(71) Applicant: Eric J. Allard, Acton, CA (US)

(72) Inventor: Eric J. Allard, Acton, CA (US)

( * ) Notice: Subject to any disclaimer, the term of this patent is extended or adjusted under 35 U.S.C. 154(b) by 58 days.

(21) Appl. No.: 17/351,922

(22) Filed: Jun. 18, 2021

(65) Prior Publication Data

US 2022/0056928 A1 Feb. 24, 2022

Related U.S. Application Data

(60) Provisional application No. 63/068,012, filed on Aug. 20, 2020.

(51) Int. Cl.
*F15B 15/19* (2006.01)
*F15B 15/20* (2006.01)

(52) U.S. Cl.
CPC ..... *F15B 15/19* (2013.01); *F15B 15/20* (2013.01)

(58) Field of Classification Search
CPC ..... F15B 15/19; F15B 15/20
USPC ..... 60/632, 635, 636, 638
See application file for complete search history.

(56) References Cited

U.S. PATENT DOCUMENTS 2,835,208 A 5/1958 Faverty
3,242,878 A 3/1966 Floehr
4,099,581 A * 7/1978 Maret ..... B22D 31/00 60/636
4,894,042 A 1/1990 Kamikawa
5,119,634 A * 6/1992 Berry ..... B25C 1/143 60/632
5,259,808 A 11/1993 Garr
5,841,057 A * 11/1998 Birk ..... F41A 13/04 89/1.25
8,900,208 B2 12/2014 Benedict et al.
9,764,248 B2 9/2017 Schwalm, Jr.
2005/0287918 A1 12/2005 Sheltman et al.
2007/0259060 A1 11/2007 Dunham

* cited by examiner

*Primary Examiner* — Hoang M Nguyen

(57) ABSTRACT

An explosively propelled piston assembly (EPPA) comprising an optional mounting plate; at least one lower cylinder fastener; a breach bolt with a base and an upward extending member; a breach plate having a plurality of surround openings; a breach gasket having a plurality of openings; a combustion piston with a base, a center opening, and upward extending side wall and a threaded opening; a piston dampening ring; a combustion cylinder having an upper section, a lower section, upward extending members and at least one ventilation bore; and a plurality of threaded plate fasteners. Once the EPPA is assembled, an explosive charge is placed into the EPPA. The charge is then activated which produces a contained explosive force that actuates the piston, causing the piston to extend outward, applying the force onto an object in contact with or adjacent to the EPPA. The force can be used to produce pushing, flipping, rolling or other movement of the object.

20 Claims, 3 Drawing Sheets

EXPLOSIVELY PROPELLED PISTON ASSEMBLY

TECHNICAL FIELD

The invention generally pertains to actuating devices, and more particularly to an explosively propelled piston assembly that provides a contained explosive force for pushing, flipping, rolling or other movement of an object.

BACKGROUND ART

For certain industries, it is sometimes necessary to instantaneously propel or otherwise move an object(s). An example of one such industry is film and television production, during which a vehicle seemingly experiences a violent action that causes the vehicle to slide, flip, roll or perform other movement. In order to produce the most realistic action, an explosive force which is powerful and instantaneous, is typically utilized.

The most common device employed for this purpose is an explosively activated piston. A common implementation utilizes a breach load, screw-in design, with the breach having an off-set retainer or other means to contain the breach from the explosive force. This design does function as intended and has been in use for a long time, therefore there have not been improvements or new designs that will function more effectively.

The instant invention does offer improvements by utilizing the best design characteristics of the prior/current art, and modifying these designs to provide a contained explosive force that actuates a piston while providing consistent power based on the size of an explosive or pneumatic force.

A search of the prior art did not disclose any literature or patents that read directly on the claims of the instant invention. However, the following U.S. patents are considered related:

| PAT. NO. | INVENTOR | ISSUED |
|---|---|---|
| 8,900,031 | Benedict, et al | Dec. 2, 2014 |
| 9,764,248 | Schwalm Jr. | Sep. 19, 2017 |

The U.S. Pat. No. 8,900,031 discloses a toy vehicle that includes a vehicle body configured for moving along a support surface when disposed in a first orientation. A platform is rotatably coupled to an underside of the vehicle body, and a lever is pivotally coupled to the platform. The lever causes the vehicle to be overturned from a first orientation when the lever is moved from a first position to a second position.

The U.S. Pat. No. 9,764,248 discloses a pressure contained car cannon for the launching and/or flipping of vehicles, or other large-scale props. The device consists of a barrel, a cannon foot and a piston. By way of pneumatic pressure, force is achieved by transferring energy from the piston to the cannon foot, resulting in a push force which expels the cannon foot from the cannon barrel.

For background purposes and indicative of the art to which the invention relates, reference may be made to the following remaining patents found in the patent search.

| PAT. NO. | INVENTOR | ISSUED |
|---|---|---|
| 2,835,208 | Faverty | May 20, 1958 |
| 3,242,878 | Floehr | Mar. 29, 1966 |
| 4,894,042 | Kamikawa | Jan. 16, 1990 |
| 5,259,808 | Garr | Nov. 9, 1993 |
| 2005/0287918 | Sheltman, et al | Dec. 29, 2005 |
| 2007/02590601 | Dunham | Nov. 8, 2007 |

DISCLOSURE OF THE INVENTION

An explosively propelled piston assembly comprising an optional mounting plate having a circular center opening and at least one corner opening. By placing at least one screw, at least one bolt, at least one nail or other securing means through the corner opening(s), the mounting plate can be secured onto a surface. Extending from the mounting plate are at least one lower cylinder fastener. Extending upward at the center of the fastener(s) and mounting plate center opening is a breach bolt, with a base and an upward extending member. Above the breach bolt is a breach plate with a plurality of surround openings. A breach gasket interfaces with and extends upward on the breach plate via openings that correspond to fasteners on the breach plate. Extending upward from the breach plate is a combustion piston having a base, a center opening, an upward extending side wall, and a threaded opening. A piston dampening ring is located above and interfaces with the upper end of the combustion piston. A combustion cylinder has an upper section, a lower section and an upward extending member circumventing the perimeter of the lower section. At least one ventilation bore extends through the cylinder to allow explosive or pneumatic gas to escape, thereby relieving pressure within the piston assembly. Located above the combustion cylinder is a combustion piston adapter plate that has plate bores and at least one corner opening for securing the adapter plate. Extending downward through the adapter plate are a plurality of threaded plate fasteners that extend into threaded openings on the upper end of the combustion piston.

Once assembled, an explosive charge is placed into the piston assembly. The charge is then activated which products a contained explosive force that actuates the piston, causing the piston to extend outward, applying the force onto an object in contact with or adjacent to the piston assembly.

In view of the above disclosure the primary object of the invention is to provide an explosively propelled piston assembly that can produce an instantaneous force on an object to push, flip or roll the object.

In addition to the primary object, it is also an object of the invention to provide an explosively propelled piston assembly that:

- is easy to use,
- can produce additional movement(s), or function as an impact device,
- is robust and durable,
- can be made in a variety of sizes,
- can be used vertically or horizontally,
- can be made watertight for use underwater,
- can be used for other purposes including cutting rope, wire, chain or other material, or for hurling an object,
- can be used as a support structure,
- is particularly effective for use in film and television productions for special effects,
- is easy to transport, can be used in arrangements of multiple piston assemblies for large/heavy applications, can be used repeatably, and is cost effective from both a manufacturer's and user's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
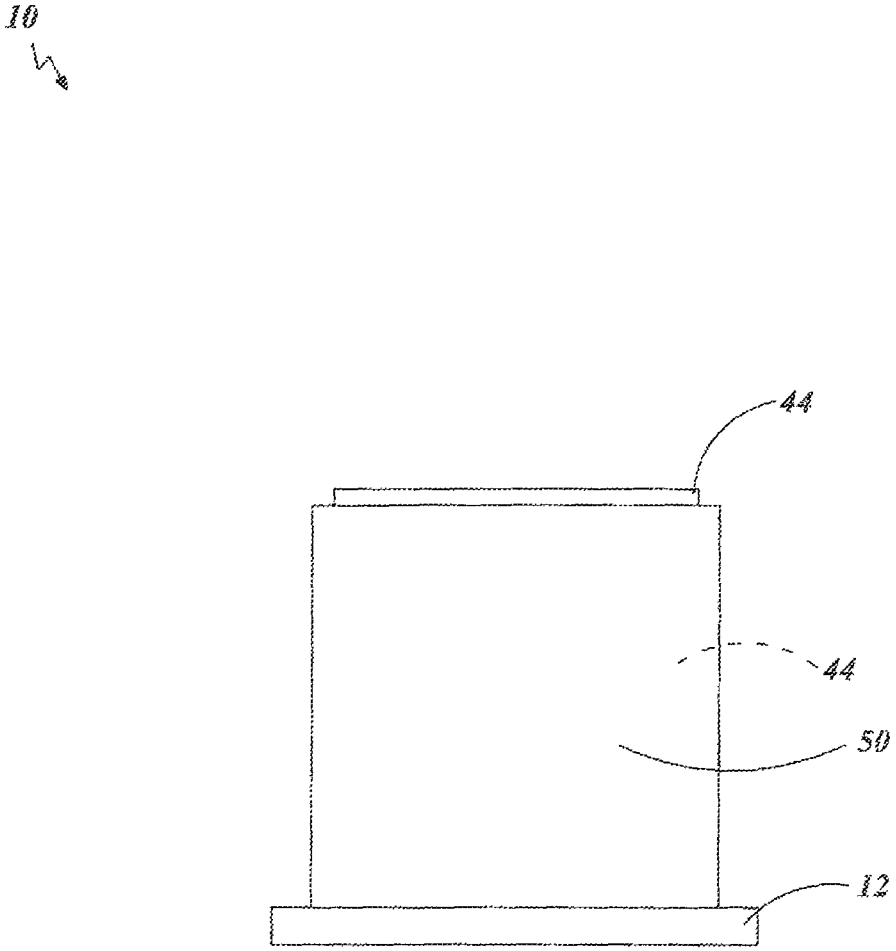
FIG. 1 is an elevational side view showing an explosively propelled piston assembly (EPPA).
Figure 2:
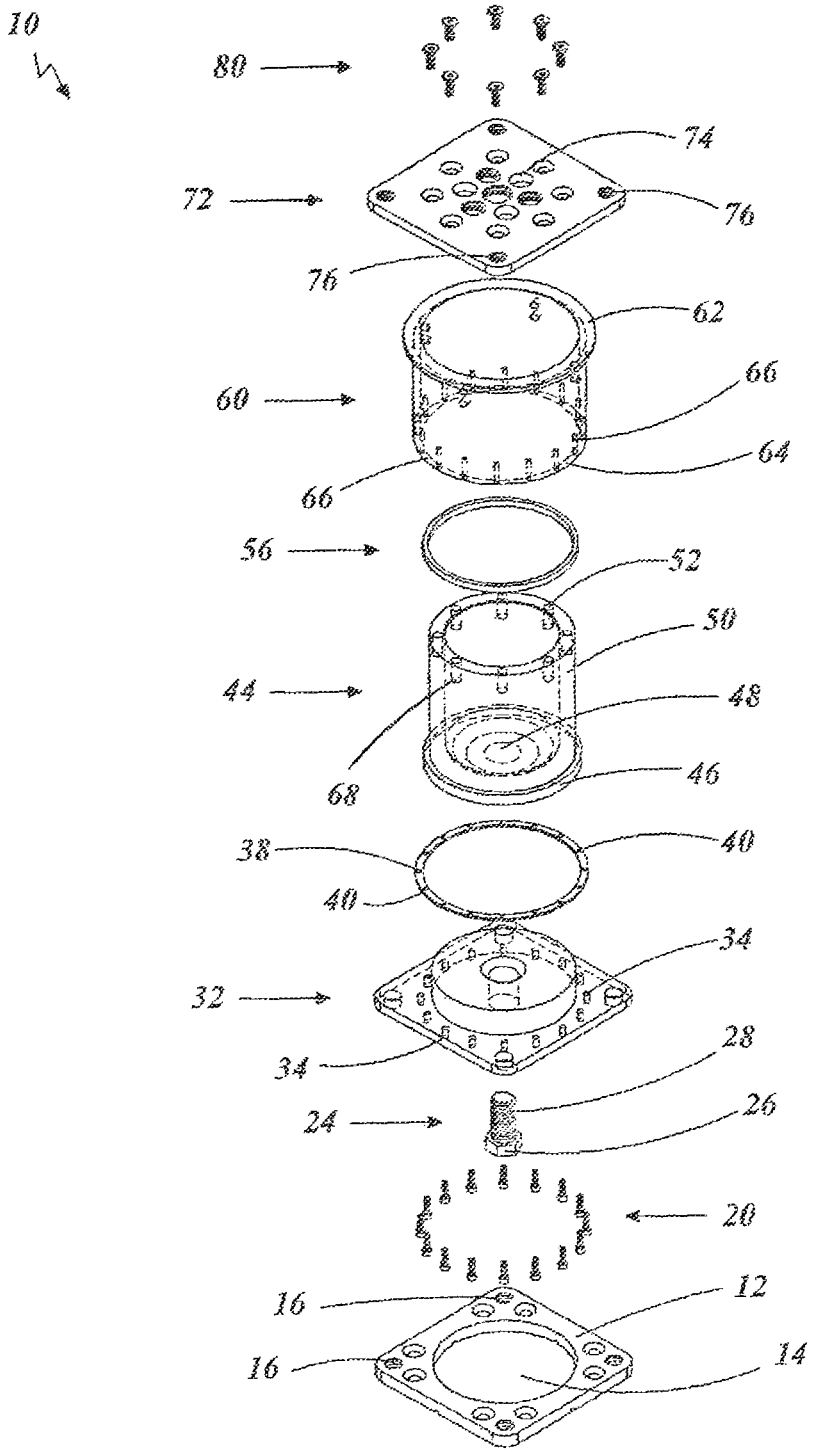
FIG. 2 is an exploded view showing the EPPA.

The best mode for carrying out the invention is presented in terms that disclose a preferred embodiment of an explosively propelled piston assembly (EPPA), which is know as the "Load Lifter"™. In certain industries it is sometimes necessary to push, flip, roll or perform other movement of an object. One industry that requires this capability is the film/television production. The most typical example of the functionality is when a vehicle experiences a violent action. In order to accomplish a realistic and controlled action, such as a vehicle flipping over, an explosively actuated piston is usually utilized. These devices have been in use for some time, but there are negative aspects to the use. The EPPA 10, as shown in FIGS. 1-5, provides an improved design of an explosively propelled piston that offers increased performance characteristics compared to other/prior art similar devices.

The EPPA is comprised of the following major elements: a mounting plate 12, a breach bolt 24, a breach plate 32, a combustion piston 44, and a combustion cylinder 60. While the EPPA 10 can be placed in any orientation, depending on the requirement of use, for the purpose of this disclosure the EPPA 10 will be described and shown in an upright/vertical orientation, with the force directed upward and outward. Also, the EPPA 10 can be manufactured in a variety of shapes/dimensions, again depending on the requirement of use. For this disclosure, a substantially circular design will be disclosed and shown. Also, it should be noted, that while the EPPA can be utilized both vertically and horizontally, for this disclosure the EPPA will be described from an upright, vertical perspective. To provide the greatest amount of structural integrity the assembly of the EPPA 10 utilizes an opposed/keyed interface that is maintained by at least one, and preferably multiple, attachment means such as screws.

The mounting plate 12, as shown in FIG. 1, has a circular center opening 14 and at least one corner opening 16. By placing at least one screw, at least one bolt, at least one nail or at least one other securing means through the corner opening(s), the mounting plate 12 can be secured onto a surface. It should be noted that for certain applications a mounting plate is not required and/or desired. In these cases, the mounting plate 12 is not utilized, which does not affect the operation of the EPPA 10.

Figure 3:
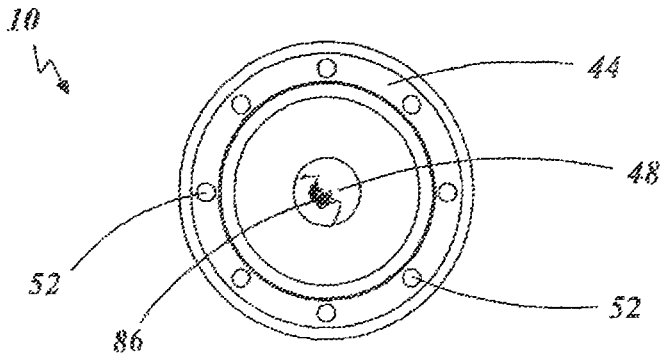
FIG. 3 is an elevational side view showing the EPPA breach bolt.

As shown in FIG. 1, extending upward from the mounting plate 12 are a plurality of lower cylinder fasteners 20, preferably arranged in a circular configuration. Extending upward at the center of the fasteners and mounting plate center opening is the breach bolt 24 that has a base 26 (which can also be identified as the bolt head) and an upward extending member 28, as shown in FIGS. 1 and 3. Above the breach bolt 24 is the breach plate 32 that has surround openings 34 into which the plurality of fasteners are inserted. The breach bolt 24 upward extending member 28 extends up through the substantial center of the breach plate 32. A breach gasket 38 preferably made of copper interfaces with the breach plate via a plurality of openings 40 that correspond to the fasteners 20 extending upward through the breach plate 32.

Figure 4:
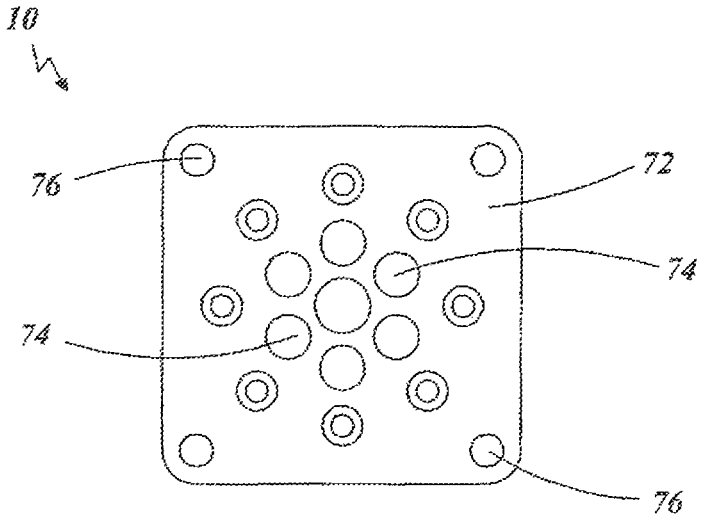
FIG. 4 is a top plan view showing the EPPA combustion piston.

As shown in FIGS. 1 and 4, extending upward from the breach plate 32 is the combustion piston 44 that includes a base 46, a center opening 48, upward extending side wall 50 and a threaded opening 52. Located above and interfacing with the upper end of the combustion piston 44 is a piston dampening ring 56.

As shown in FIG. 1, the combustion cylinder 60 includes an upper section 62 and a lower section 64 with upward extending members 66 circumventing the perimeter of the lower section. Ventilation bores 68 extending through the cylinder 60 allow an explosive 86 or pneumatic gas to escape as the piston extends outward. Once the piston is at a final extended length engaging the piston dampening ring 56, the ventilation bores 68 allow gas to escape, thereby relieving pressure within the EPPA 10.

Figure 5:
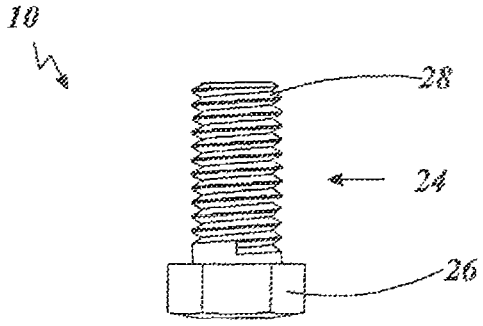
FIG. 5 is a top plan view showing the EPPA combustion piston adapter plate.

Above the combustion cylinder 60 is a combustion piston adapter plate 72. As shown in FIGS. 1 and 5, the plate 72 has plate bores 74 and at least one corner opening 76 for securing the plate 72. The design of the adapter plate 72 can be universal for a variety of applications, or can have a use-specific design for specializes application.

As shown in FIG. 1 extending downward into and through the adapter plate are a plurality of threaded plate fasteners 80 that extend into corresponding threaded openings on the upper end of the combustion piston 44.

Once assembled, an explosive charge 86 is placed into the EPPA 10. The charge is then activated which produces a contained explosive force that actuates the piston, causing the piston to extend outward, applying the force onto an object in contact with, or adjacent to, the EPPA. Consistent power from the EPPA 10 is achieved based on the size of the explosive/pneumatic force.

In addition to the previously disclosed pushing, flipping, rolling or other movement, the EPPA 10, can also be used as an impact device or with an adapter for specific tasks such as cutting rope, wire, chain or other materials, or for hurling an object and other user-specific purposes that require instantaneous actuation (i.e., a push).

In an alternate functionality, the piston remains in an extended position after an explosive force. In this position, the piston can be utilized as a support for various objects. Also, if the combustion cylinder chamber is made water-tight, the EPPA can be used, with modification, in/under water. It is important to note that the force within the EPPA is a contained force which results in control and lessening of the typical reactionary effects that occur when using an explosive.

While the invention has been described in detail and pictorially shown in the accompanying drawings it is not to be limited to such details, since many changes and modification may be made to the invention without departing from the spirit and the scope thereof. Hence, it is described to cover any and all modifications and forms which may come within the language and scope of the claims.

The invention claimed is:

1. An explosively propelled piston assembly comprising:
at least one lower cylinder fastener,
a breach bolt with:
a base,
an upward extending member,
a breach plate having a plurality of surround openings,
a breach gasket having a plurality of openings,
a combustion piston having:
a base,
a center opening,
an upward extending side wall,
a threaded opening,
a piston dampening ring,
a combustion cylinder having:
an upper section,
a lower section,
upward extending members,
at least one ventilation bore and
a plurality of threaded plate fasteners.

2. The explosively propelled piston assembly of claim 1, wherein an explosive charge is configured within the piston assembly to produce a contained explosive force that causes the piston to extend outward, thereby applying the force onto an object in contact with or adjacent to the piston assembly.

3. The explosively propelled piston assembly of claim 1, wherein the piston assembly is made of metal selected from the group consisting of steel, aluminum, titanium, and a metal composite.

4. The explosively propelled piston assembly of claim 1, wherein the piston assembly is made of carbon fiber.

5. The explosively propelled piston assembly of claim 1, wherein the piston assembly is configured to produce movement of an object, the movement selected from the group consisting of pushing, flipping and rolling.

6. The explosively propelled piston assembly of claim 1, wherein the piston assembly is configured to function as an impact device.

7. The explosively propelled piston assembly of claim 1, wherein the piston assembly is configured to function as a support structure.

8. The explosively propelled piston assembly of claim 1, wherein the piston assembly is watertight.

9. An explosively propelled piston assembly comprising:
a mounting plate having a circular center opening and at least one corner opening,
securing means inserted through the at least one corner opening and into a surface,
a plurality of lower cylinder fasteners extending upward from the mounting plate in a circular configuration,
a breach bolt extending upward at a center of the fasteners and mounting plate center opening, the breach bolt comprising a base and an upward extending member,
a breach plate located above the breach bolt and having surround openings into which the plurality of lower cylinder fasteners are inserted, and with the breach bolt's upward extending member extending upward through the substantial center of the breach plate,
a breach gasket having a plurality of openings that are configured to correspond to the fasteners extending upward through the breach plate,
a combustion piston that extends upward from the breach plate, and having a base, a center opening, an upward extending side wall, and a threaded opening,
a combustion dampening ring that is located above and interfaces with an upper end of the combustion piston,
a combustion cylinder comprising an upper section, a lower section, upward extending members circumventing a perimeter of the lower section, and at least one ventilation bore extending through the combustion cylinder,
a combustion piston adapter plate located above the combustion cylinder and having plate bores and at least one corner opening,
a plurality of threaded plate fasteners extending downward into and through the adapter plate, and into corresponding openings on an upper end of the combustion piston, and
an explosive charge that is placed into the piston assembly and when activated produces a contained explosive force that actuates the piston, causing the piston to extend outward, applying the force onto an object in contact with or adjacent to the piston assembly.

10. The explosively propelled piston assembly of claim 9, wherein the piston assembly is made of metal selected from the group consisting of steel, aluminum, titanium, and a metal composite.

11. The explosively propelled piston assembly of claim 9, wherein the piston assembly is made of carbon fiber.

12. The explosively propelled piston assembly of claim 9, wherein the piston assembly is configured to produce movement of an object, the movement selected from the group consisting of pushing, flipping and rolling.

13. The explosively propelled piston assembly of claim 1, wherein the piston assembly is configured to function as an impact device.

14. The explosively propelled piston assembly of claim 1, wherein the piston assembly is configured to function as a support structure.

15. The explosively propelled piston assembly of claim 1, wherein the piston assembly is watertight.

16. The explosively propelled piston assembly of claim 9, wherein the securing means are selected from the group consisting of at least one screw, at least one bolt, at least one nail and an adhesive.

17. The explosively propelled piston assembly of claim 9, wherein the ventilation bores allow an explosive or pneumatic gas to escape as the piston extends outward, and once the piston is at a final extended length engaging the piston dampening ring, the ventilation bores allow gas to escape, thereby relieving pressure within the piston assembly.

18. The explosively propelled piston assembly of claim 9, wherein the combustion piston adapter plate is configured for a variety of applications or is configured for a single-use specific application.

19. The explosively propelled piston assembly of claim 9, wherein the explosive force is a contained explosive force which results in control and lessening of reactionary effects that occur when using an explosive.

20. The explosively propelled piston assembly of claim 9, wherein the components of the piston assembly are assembled utilizing an opposed keyed interface that is maintained by at least one screw.

* * * * *